United States Patent [19]

Gorondy

[11] 4,419,102

[45] Dec. 6, 1983

[54] PROCESS FOR LEVEL DYEING OF TEXTILES BY HEAT TRANSFER

[75] Inventor: Emery J. Gorondy, Kennett Square, Pa.

[73] Assignee: E. I. Du Pont de Nemours & Co., Wilmington, Del.

[21] Appl. No.: 98,977

[22] Filed: Nov. 30, 1979

[51] Int. Cl.[3] ..... D06P 5/00

[52] U.S. Cl. ..... 8/471; 8/485; 8/512; 8/922

[58] Field of Search ..... 8/2.5 A, 4, 471, 485, 8/512, 922

[56] References Cited

U.S. PATENT DOCUMENTS

| | | | |
|---|---|---|---|
| 3,508,492 | 4/1970 | Seibert et al. | 8/2.5 A |
| 3,707,346 | 12/1972 | Markert et al. | 8/2.5 |
| 3,860,388 | 1/1975 | Haish | 8/471 |
| 3,915,628 | 10/1975 | Bossard et al. | 8/2.5 R |
| 4,056,352 | 11/1977 | Mayer | 8/2.5 A |
| 4,124,384 | 11/1978 | Centa | 8/471 |

FOREIGN PATENT DOCUMENTS

| | | |
|---|---|---|
| 40-15873 | 7/1965 | Japan . |
| 1392390 | 4/1975 | United Kingdom . |
| 1432197 | 4/1976 | United Kingdom . |

OTHER PUBLICATIONS

C. E. Vellins "Transfer Printing" in Venkataraman's The Chemistry of Synthetic Dyes, vol. VIII (Academic Press, 1978), pp. 191–220.

*Primary Examiner*—A. Lionel Clingman

[57] ABSTRACT

A process is provided wherein film (e.g. polyester) which has been dyed by at least one disperse dye, is contacted with textile material in the presence of sufficient heat to cause the dye to sublime or vaporize and transfer some of the dye from the film to the textile material, thereby effecting level dyeing of the textile material. Both the film and textile material have affinity for the dye, and softening points which are higher, and glass transition temperatures which are lower, than the temperature needed to effect sublimation or vaporization and transfer of the dye. Also a process is provided wherein film is continuously dyed with at least one disperse dye and thereafter continuously contacted with a textile material at elevated temperature so as to sublime or vaporize the dye and transfer dye from the film to the textile material.

30 Claims, No Drawings

PROCESS FOR LEVEL DYEING OF TEXTILES BY HEAT TRANSFER

BACKGROUND OF THE INVENTION

1. Field of the Invention

This invention relates to a process wherein a film containing at least one dye is contacted with a textile material in the presence of sufficient heat to cause the dye (or dyes) to sublime or vaporize and transfer some of it from the film to the textile material, and thereby provide textile material level dyed in a solid shade.

2. Description of the Prior Art

In recent years, it has become a common commercial practice to print textile material by subliming or vaporizing and transferring dyes from paper carriers printed or coated with disperse dyestuffs in the form of an ink or paste; i.e. dyestuff plus binder. The textile material is contacted with the printed paper carrier in the presence of heat. In some processes, heating is accompanied by pressure. In others, vacuum is applied during or after the heating step.

While superficially, it may seem possible to achieve level dyeings of textile materials by the abovedescribed techniques, due to economic and/or technological limitations, none has been reported in commerce. Possible reasons for the state of the commercial art reside in the nature of the dye carrier and the means available for coating it.

In order to achieve level dyeing of the textile material, the coating on the carrier must be very uniform. The gravure technique, wherein coated paper (e.g. by clay) is used, might seem to be capable of achieving uniform coating of the carrier with a dye (in the form of an ink). However, one cannot meter ink exactly across the entire length and width of the carrier paper so as to achieve level solid shade dyeing therefrom by heat transfer. Moreover, it is expensive, both in terms of capital investment and in operating costs. The lithographic printing technique does not provide a continuous surface from which ink or print paste can be transferred. Ink can be metered less exactly with the flexographic process than the gravure technique. The rotary screen printing technique requires the use of a water-based ink, but clay-coated paper may not be used, because the water would cause the paper to pucker. If other paper is used with water-based inks, the dye thereof penetrates into the microstructure of the paper, and on heating would diffuse further into the paper, making it impractical, if not impossible, to effect level dyeing from the paper to a textile material.

Markert et al., in U.S. Pat. No. 3,707,346, disclose heat transfer printing of textiles wherein one or more anthraquinone disperse dyestuff is applied to one or both sides of a carrier for which the disperse dyestuff do not possess affinity. Preferably, the carrier is paper, but a metal substrate is disclosed as well.

Bossard et al., in U.S. Pat. No. 3,915,628, also disclose the use of a carrier having no affinity for the compound (including dyestuffs) which is to be transfer-printed on textile material by vaporization in the presence of heat. Their carrier is a continuous, endless structure to which the varporizable material is applied by spraying, coating or printing. The endless inert carrier may be metal, such as aluminum or steel, plastic, water- and optionally solvent-resistant paper, or textile fabrics, which are optionally coated with a film of vinyl resin, ethyl cellulose, polyurethane resin or a polytetrafluoroethylene resin.

Mayer, in U.S. Pat. No. 4,056,352, discloses the continuous dry transfer of organic compounds (including disperse dyestuffs) to webs of air-permeable organic materials (including textile webs) by passing the webs and the organic compound carriers over at least one heating means and subsequently over at least one suction means. As a rule, the carrier possesses no affinity for the preparation that contains the compound to be transferred (e.g. the dyestuff preparation). The preparations are applied to the inert carrier continuously by spraying, coating or preferably by printing over part or all of the surface of the carrier. If the carrier is air-permeable, and depending on the sublimation behavior of the compounds to be transferred, the untreated or treated side of the carrier may be brought into contact with the surface of the web to be treated. If, as is preferred, the carrier is impermeable to air, only the treated side of the carrier is brought into contact with the surface of the web material to be treated.

Sublistatic Holding S.A., in U.K. Patent Specification No. 1,392,390, disclose dry heating a textile material in contact with a flexible support which is coated or impregnated with a layer of a dyestuff or an optical brightening agent so as to cause the dyestuff or brightening agent to sublime or vaporize, and thereby transfer the same to the textile web. Paper or aluminum, preferably a paper sheet or web coated with a varnish to make it impermeable to air, is disclosed for use as the flexible support.

SUMMARY OF THE INVENTION

The present invention relates to a process in which polyester film dyed with at least one disperse dye is contacted with a textile material at a temperature which is sufficiently high so as to effect sublimation or varporization of the dye and transfer some of the dye from the film to the textile material, and thereby effect level dyeing of the textile material. In another aspect, the present invention provides level dyeing of textile materials wherein polyester film is continuously dyed with at least one disperse dye and thereafter continuously contacted with a textile material at elevated temperature so as to sublime or vaporize the dye and transfer dye from the film to the textile material.

Whenever used herein, "polyester" means conventional polyethylene terephthalate which may or may not be modified in ways which are well known in the art. Likewise, wherever dyeing a film or textile material with at least one disperse dye is mentioned herein, it is to be distinguished from the application to a substrate of a coating containing a disperse dye. Simply applying the disperse dye to a substrate having affinity for disperse dyes will not result in dyeing. Such substrates, e.g. polyester, are made up of long polymer chains held to one another by very strong intermolecular cohesive forces. In order to dye such a substrate, it is necessary to overcome such forces so as to enable the disperse dye molecules to penetrate the substrate. Without such penetration, only a coating will result which, absent binders or the like, will not survive useage. One can overcome such forces by supplying thermal energy to the system. Thus when the polymer is heated to the glasstransition temperature and above, polymer chain vibrations begin to overcome the cohesive forces and continue to do so until the softening point is reached. Between the Tg and softening point of the polymer, the disperse dye molecules can penetrate between polymer molecules, whereby on cooling, the dye molecules are held in place (said to be a solid solution).

DETAILED DESCRIPTION OF THE INVENTION

The present invention provides a batch or continuous process by which level dyeing of textile materials can be obtained by heat transfer from dyed polyester film. In one embodiment of this invention, polyester film is dyed, washed and dried, using equipment known in the art, e.g. that disclosed in U.S. Pat. No. 3,558,260 or 4,055,971. Thereafter, the dyed film can be run continuously to conventional equipment used for heat transfer printing of textiles, in which the dye is continuously transferred from the film to the textile fabric in the presence of heat. In a modification of the above-described technique, the film is wound up on a roll and stored until such time as level dyeing of textile materials therefrom is desired. In another embodiment of this invention, one uses commercially available dyed polyester film in the heat transfer step.

The dyeing step is performed in a high-boiling solvent exemplified in U.S. Pat. No. 2,938,811. The preferred solvent is diethylene glycol. Other such liquids include ethylene glycol, dipropylene glycol, butylene glycol and glycerine.

Such solvents are necessary so as to enable one to operate the dyeing step at temperatures of at least about 120° C. As a practical matter, the only upper limits to the temperature at which the film is dyed are thermal stability of the dye molecule, the boiling point of the solvent and the softening point of the film. The boiling point of the preferred solvent, diethylene glycol, is about 245° C. while the softening point of the polyethylene terephthalate from which the film is made may be as low as 230° C. Usually, the dyeing-temperature does not exceed about 215° C. In order to avoid distortions in the film, particularly those 0.25 to 0.5 mil in thickness, it is preferably dyed at temperatures of about 180° C. or less. After the film is dyed, it is usually washed, e.g. in a relatively low-boiling liquid such as methanol or ethanol, chloroform or dichloromethane, as disclosed in U.S. Pat. No. 4,047,889. On the other hand, the dyed film can be washed with water as disclosed in U.S. Pat. No. 2,938,811. After washing the film, it is dried. Following the heat transfer step, the entire sequence can be repeated, redyeing the film and heat transferring dye therefrom to textile fabric.

Being dyeable with disperse dyes, it is manifest that the polyester film has an affinity for such dyes. The film may be of any thickness, so long as it is self-supporting. Polyester films which are 0.25 to 5 mils in thickness can be used. Those having thicknesses at the upper end of the range are more difficult to use because they give a thermal insulating effect. Consequently, it takes more energy and time to effect sublimation or vaporization and transfer of enough dye to achieve adequate dyeing of the textile material. From the standpoint of cost and durability to handling, the film is preferably 0.5 to 1 mil thick. Not only must the softening point of the polyester, from which the film is prepared, be above the sublimation temperature of the disperse dye, but its glass transition temperature must be below that sublimation temperature.

The disperse dyes used according to the invention must be sublimable or vaporizable at a temperature below the softening point of the polyester film as well as that of the fabric to which the dye is transferred from the film. Usually, the disperse dyes will have adequate vapor pressure to transfer at a temperature between about 150° and 220° C., preferably between 175° and 215° C. For the most part, they are low-energy to medium-energy dyes. Examples of such dyes are disclosed in U.S. Pat. No. 3,915,628.

In the heat transfer step, the polyester film and the textile material are brought into, and maintained in, contact with one another at a temperature sufficiently high so as to effect sublimation or vaporization of the disperse dye contained in the film, for so long as it takes the desired amount of dyestuffs to be transferred from the film to the textile material. The temperature, at which the film and textile materials are contacted, must be at or above the sublimation temperature of the dye. In addition, it must be at or above the glass transition temperature of the film or textile, whichever has the higher Tg. Moreover, that temperature must not exceed the softening point of the film or textile material.

As a rule, the film and textile material are heated together at a temperature between 150° and 220° C. (preferably between 175° and 215° C.) for a brief period of time, e.g. 10–90 seconds. The heat transfer step may be carried out continuously or on a batch basis. Heat can be supplied by use of heated rolls, steam, infrared or hot dry air, under atmospheric pressure or under vacuum. Apparatus for carrying out the heat transfer step is well known in the art, see for example U.S. Pat. Nos. 3,768,280; 4,030,962; 4,057,864; 4,116,022; or 4,117,699; or U.K. Patent Specification Nos. 1,227,681; 1,399,095; or 1,423,358.

For example, the dyed film can be contacted with the heated roll surface of a calendar, and the textile material brought into contact with the film while it is in contact with the heated roll. Usually, a layer of textile material, i.e. fabric, is brought into direct contact with a heated surface while the textile material is in contact with the film. In a preferred embodiment, the film is sandwiched between two layers of textile material, with both layers of textile material being heated, e.g. the inner layer of textile material being heated by a heated roll and the outer layer of textile material by some other heat source, such as infrared heaters. In order to effect dyeing of both layers to same depth of shade, it is necessary to heat the inner and outer layers of any such sandwich configuration to the same extent. Moreover, in order to effect transfer of the disperse dye in as short a period of time as possible, one should pre-heat the textile material just before bringing it into contact with the dyed film, preferably by contacting the textile material with a heated surface.

One may control the heat introduced in the heat transfer step, in terms of time and temperature, so as to control the amount of dye which is transferred from the film to the textile material. If the film and undyed textile material are heated in contact with one another at or above the sublimation or vaporization temperature of the dye for a sufficiently long period substantial equilibrium will be reached, and thereafter no significant amount of dye will transfer from that film to that textile material. If other undyed textile material is thereafter heated in contact with that same film at or above the sublimation or vaporization temperature of the dye, additional dye will transfer from the film to the textile material. If again heated at that temperature for a sufficiently long period, equilibrium will again be reached. The transfer of dye may also be run (initially or subsequently) for a sufficiently short period at or above the vaporization or sublimation temperature of the dye that equilibrium is not reached in transfer of dye from film to textile material.

The process of this invention can be used to effect level dyeing of the textile materials so as to give a variety of results. The textile material can be dyed on one side only. By controlling time and temperature of dyeing, the dye can be caused to migrate from one side of the textile material to the other so as to give level dyeing in the same shade on both sides thereof. On certain fabric constructions, it is possible to obtain two different colors on opposite faces of single layer of fabric from a single film. One can dye the film with two disperse dyes that have a great difference in vapor pressure and/or diffusion coefficient. In that event, the face of the fabric, away from the dyed film, will have the color of the faster diffusing dye while the face next to the film will have the color of the dye mixture. Level dyeing of the two sides of the textile material in different shades or colors can also be accomplished directly according to the process of this invention. Thus, in the presence of heat, one side of the textile material is contacted with polyester film dyed with a disperse dye giving a particular shade or color, and the other side thereof with film dyed with a different disperse dye. Such a procedure can be performed in a single step or it can be carried out in sequential steps. In addition to sandwiching a layer of film between two layers of textile material, one can make multiple sandwiches in which three, four or more layers of textile material alternate with two, three of more layers of film dyed to the same or different shades by the same or different dyes.

The textile materials may be in the form of fibers or fabric, woven, non-woven (e.g. spunbonded) or knitted. Most commonly, they would be knitted. Cellulose acetate and nylon 6 have softening points of about 190° and 170° C., respectively. Since the preferred disperse dyes require temperatures in the range between about 175°–215° C. for effective heat transfer, textile materials prepared from those polymers would not be acceptable as preferred embodiments. Neither cellulose triacetate, nylon 66 nor acrylic textile materials are preferred. While they have sufficiently high softening points: 225, 235 and 215°–255° C., respectively, they exhibit poor wash-fastness properties when dyed by heat transfer. "Qiana" nylon is suitable in light and medium shades when dyed by heat transfer, but in deep shades it cannot meet the sublimation fastness requirements for the "Qiana" label, and is therefore not preferred herein. That leaves polyester textile materials as the most suitable for use according to this invention.

The following examples are given by way of illustration and not limitation. In the examples, parts are by weight and temperatures in centigrade unless otherwise specified.

While the films used according to this invention are particularly described herein as polyester, film prepared from other polymers can be used as well. Such polymers must have affinity for the dyestuff being used, softening point that is higher, and glass transition temperature that is lower, than the temperature needed to effect sublimation or vaporization and transfer of the dyestuff to the textile material. For example, one can use film prepared from the polymers from which textile materials suitable for this invention are made, described above, viz, cellulose triacetate, acrylics, nylon 66 (polyhexamethylene adipamide) and "Qiana" type nylon [the polyamide made from dodecanedioic acid and bis-(4-aminocyclohexyl)methane].

EXAMPLE 1

A piece of 0.5 mil commercially dyed polyester film, measuring 12 inches by 10 inches containing a mixture of three sublimable dyes (Disperse Yellow 54, Disperse Blue 60, and Disperse Red 60) was placed in a hot plate on top of an undyed 100% polyester fabric (Type 56 "Dacron" 150 den 34 filament 214 g/m$^2$ texturized double-knit). After 30 seconds at 210°, a very level dyeing of the top surface only of the fabric had been obtained, the bottom surface remaining undyed.

EXAMPLE 2

Example 1 was repeated using commercially dyed polyester film containing Disperse Violet 17 and Disperse Blue 56 dye to give very level dyeing on one side only of the polyester fabric.

EXAMPLE 3

Example 1 was repeated except that the polyester fabric was sandwiched between two layers of polyester film dyed with Disperse Blue 56. After 40 seconds at 210°, both sides of the polyester fabric showed very level dyeing at the same shade.

EXAMPLE 4

Example 3 was repeated except that one layer of film contained the same dyes as the film in Example 1 and the other layer of film contained the same dye as in Example 3. A fabric was obtained which was level dyed one color on one side and a different color on the other side.

EXAMPLE 5

The procedure of Example 1 was repeated using a different type of polyester fabric (a 5.7 oz./yd.$^2$ 70-denier interlock) and a 0.5 mil polyester film which had been dyed commercially with a mixture of Disperse Violet 17 (a "low energy" dye with high transfer and diffusion rates) and Disperse Blue 56 (a much "higher energy" disperse dye). After 60 seconds in the hot plate at 210°, the face of the polyester fabric away from the film was red, because only the Violet 17 diffused through the fabric, while the face of the fabric next to the film was dark grey, since both the Violet 17 and the Blue 56 dyes were present.

EXAMPLE 6

A commercially dyed 0.5 mil polyester film containing Disperse Blue 56, in deep shade, was placed between two undyed polyester fabrics (same type as in Example 1) and was heated for 30 seconds in a hot plate at 210°. Two fabrics were obtained, each level dyed on one face only. Then the same film sample was placed again between two undyed polyester fabrics in a hot plate at 210° and the dwell time was increased to 45 seconds. The resulting fabrics were level dyed on one face only to almost the same depth of shade as the fabrics obtained in the first transfer. The same film was again placed in a hot plate with two undyed polyester fabrics, and by increasing the dwell time of 60 seconds at 210°, a very similar depth of shade was obtained as in the first two transfers. That is, from one deep dyed film, six polyester fabrics were dyed to a very similar depth of shade by maintaining the same transfer temperature but progressively increasing the transfer time.

EXAMPLE 7

Using the Kannegiesser TD 16/20 heat transfer printing calendar, a 0.5 mil polyester film dyed with Disperse Violet 17 was fed between two layers of 100% polyester fabric to a drum heated to 204° to 210°. After about 30 seconds dwell time, very level dyeing on one face only of each fabric resulted.

I claim:

1. A process comprising dyeing polymeric film at a temperature between about 120° C. and less than the softening point of the film with a disperse dye dissolved in an organic solvent for the dye having a boiling point above the dyeing temperature, and thereafter contacting said dyed film with a polymeric textile material in the presence of sufficient heat to cause said dye to sublime or vaporize and transfer some of said dye from said film to said textile material, whereby level dyeing of said textile material is effected; both said film and textile material having affinity for said dye, softening points which are higher, and glass transition temperatures which are lower, than the temperature needed to effect sublimation or vaporization and transfer of said dye from said film to said textile material.

2. The process of claim 1 wherein, prior to heating in contact with said film, said textile material is pre-heated to a temperature not exceeding either of said softening points.

3. The process of claim 2 wherein said textile material is pre-heated by contact with a heated surface.

4. The process of claim 1, 2 or 3 wherein said textile material is positioned between said film and at least one source of heat.

5. The process of claim 4 wherein said film is positioned between two layers of said textile material.

6. The process of claim 5 wherein said dye is transferred from said film to one side only of said textile material.

7. The process of claim 5 wherein some of said dye is transferred from one side of said textile material to the other.

8. The process of claim 7 wherein both sides of said textile material are dyed substantially the same shade.

9. The process of claim 7 wherein one side of said textile material is dyed a different shade or color than the other.

10. The process of claim 9 wherein said film contains a mixture of at least two dyes which differ from one another in vapor pressure or diffusion rate or both.

11. The process of claim 4 wherein one side of the textile material is contacted with film dyed with a disperse dye giving a particular shade or color, and the other side thereof with film dyed with a different disperse dye.

12. The process of claim 11 wherein said textile material is simultaneously contacted with said films which are dyed with different disperse dyes.

13. The process of claim 11 wherein said textile material is contacted first with one of said films and thereafter with the other of said films.

14. The process of claim 5, 6, 7, 8, 9, 10, 11, 12 or 13 wherein both said film and said textile material are based on a polyester.

15. In a process wherein a disperse dye is applied continuously to a carrier and thereafter the dye is continuously vaporized or sublimed and transferred from the carrier to a textile material, the improvement comprising dyeing polymeric film at a temperature between about 120° C. and less than the softening point of the film with a disperse dye dissolved in an organic solvent for the dye having a boiling point above the dyeing temperature, and thereafter contacting said dyed film with a polymeric textile material in the presence of sufficient heat to cause said dye to sublime or vaporize and transfer some of said dye from said film to said textile material, whereby level dyeing of said textile material is effected; both said film and textile material having affinity for said dye, softening points which are higher, and glass transition temperatures which are lower, than the temperature needed to effect sublimation or vaporization and transfer of said dye from said film to said textile material.

16. The process of claim 15 wherein, prior to heating in contact with said film, said textile material is preheated to a temperature not exceeding either of said softening points.

17. The process of claim 16 wherein said textile material is preheated by contact with a heated surface.

18. The process of claim 15, 16 or 17, wherein said textile material is positioned between said film and at least one source of heat.

19. The process of claim 18 wherein said film is positioned between two layers of said textile material.

20. The process of claim 19 wherein said dye is transferred from said film to one side only of said textile material.

21. The process of claim 17 wherein some of said dye is transferred from one side of said textile material to the other.

22. The process of claim 21 wherein both sides of said textile material are dyed substantially the same shade.

23. The process of claim 21 wherein one side of said textile material is dyed a different shade or color than the other.

24. The process of claim 23 wherein said film is dyed with a mixture of at least two dyes which differ from one another in vapor pressure or diffusion rate or both.

25. The process of claim 23 wherein one side of the textile material is contacted with film dyed with a disperse dye giving a particular shade or color, and the other side thereof with film dyed with a disperse dye having a different color or shade.

26. The process of claim 25 wherein said textile material is simultaneously contacted with said films which are dyed with different disperse dyes.

27. The process of claim 25 wherein said textile material is contacted first with one of said films and thereafter with the other of said films.

28. The process of claim 19, 20, 21, 22, 23, 24, 25, 26 or 27 wherein both said film and said textile material are based on polyester.

29. The process of claim 5, 6, 7, 8, 9, 10, 11, 12, or 13 wherein three, four or more layers of textile material alternate with two, three or more layers of film so that each layer of textile material is separated from each other layer of textile material by a layer of film.

30. The process of claim 29 wherein said film and said textile material are based on polyester.

* * * * *